United States Patent [19]

Gaspari

[11] 3,976,959

[45] Aug. 24, 1976

[54] PLANAR BALUN

[76] Inventor: Russell A. Gaspari, 6656 W. 87th Place, Los Angeles, Calif. 90045

[22] Filed: July 21, 1975

[21] Appl. No.: 597,509

Related U.S. Application Data

[63] Continuation-in-part of Ser. No. 490,507, July 22, 1974, abandoned, which is a continuation-in-part of Ser. No. 387,936, Aug. 13, 1973, abandoned.

[52] U.S. Cl. ..... 333/26; 333/84 M

[51] Int. Cl.[2] ..... H01P 5/10

[58] Field of Search ..... 333/26, 84 M

[56] References Cited

UNITED STATES PATENTS

| | | | |
|---|---|---|---|
| 2,597,853 | 5/1952 | Coleman | 333/26 |
| 3,188,583 | 6/1965 | Boyd | 333/26 |
| 3,715,689 | 2/1973 | Laughlin | 333/84 M X |
| 3,771,075 | 11/1973 | Phelan | 333/84 M |

*Primary Examiner*—Paul L. Gensler

[57] ABSTRACT

A balun block for microwave and higher frequencies comprising, in one embodiment, a microstrip balun having a planar dielectric member, a ground plane of conductive material centrally positioned within said member and conducting means passing around said member in space relationship to said plane comprising means to receive an incoming guided energy wave and to split said incoming wave into two components of equal or unequal phase depending upon the state of balance of the incoming wave and means to conduct and recombine said components in predetermined phase relationships into an outgoing guided energy wave. A second embodiment comprises a stripline balun.

8 Claims, 11 Drawing Figures

PLANAR BALUN

This application is a Continuaton-in-Part of Ser. No. 490,507 filed July 22, 1974 now abandoned, which in turn, is a Continuation-in-Part of Ser. No. 387,936 filed in Aug. 13, 1973 and now abandoned.

FIELD OF INVENTION

The present invention is in the art of transformers which convert transmissions from unbalanced electrical transmission inputs into balanced electrical transmission outputs, or vice verse, i.e., balanced to unbalanced. More particularly, the present invention relates to transmission of frequencies of microwave length and higher frequencies which can be reversed as to the transmission inputs.

BACKGROUND OF THE INVENTION

A balun is a transformer between unbalanced electrical transmission lines such as a coaxial cable and microstrip and balanced electrical transmission lines such as parallel twin-lead and twisted pair.

Of the many balun designs described in recent literature, all have an upper frequency limit due to an inherent dependence upon the current flow associated with the guided wave. This is a natural restriction and arises commonly because of the application of principles that work well at lower frequencies such as UHF but become more and more difficult to apply at higher frequencies. Examples of the prior art are the well-known "bazooka" balun designs and that disclosed in U.S. Pat. No. 2,597,853.

SUMMARY OF THE INVENTION

The design proposed herein is unique from previous designs because it embodies a more complete "wave" approach. Rather than depend solely upon the currents associated with the guided wave, the wave itself is bent and shaped to the desired goal. In this way the unbalanced and balanced sections of transmission line can be matched much more effectively.

In discussing the design principles, for demonstration purposes only, it will be assumed that the unbalanced wave is an input and the balanced wave is an output. Since the device is entirely passive and the medium is entirely linear, its operation will be reciprocal and may be made to operate in the reverse direction to that described herein. Note that the assumption of microstrip as the unbalanced transmission line medium is not a severe limitation since various transitions are readily available from "stripline" to microstrip and "coax" to microstrip.

The basic principle of operation is the separation of the incoming wave into two components which may be recombined in proper phase to produce the desired balance or unbalance result. A microstrip T junction can form the power splitting function and may be made virtually reflectionless by matching the input microstrip characteristic impedance to the sum of the two output microstrip characteristic impedances. This can be controlled by the strip widths.

The two separate wave components leave the T junction with equal phase. If each were given an equal length to traverse before arriving at the balanced line launching point, then they would still be in phase and they would re-combine destructively. (The energy contained in the incident wave would return to the input as an infinite VSWR, as indicated in FIG. 2A). If, however, one portion of the wave is delayed one-half wavelength with respect to the other, then when they arrive at the transmission line launching point their amplitudes reinforce and, with a proper dielectric impedance match, the wave may be launched as a balance output as sketched in FIG. 2B.

BRIEF DESCRIPTION OF THE DRAWINGS

FIG. 2A shows destructive recombination and FIG. 2B shows constructive recombination.

DESCRIPTION OF THE PREFERRED EMBODIMENT

Figure 1:
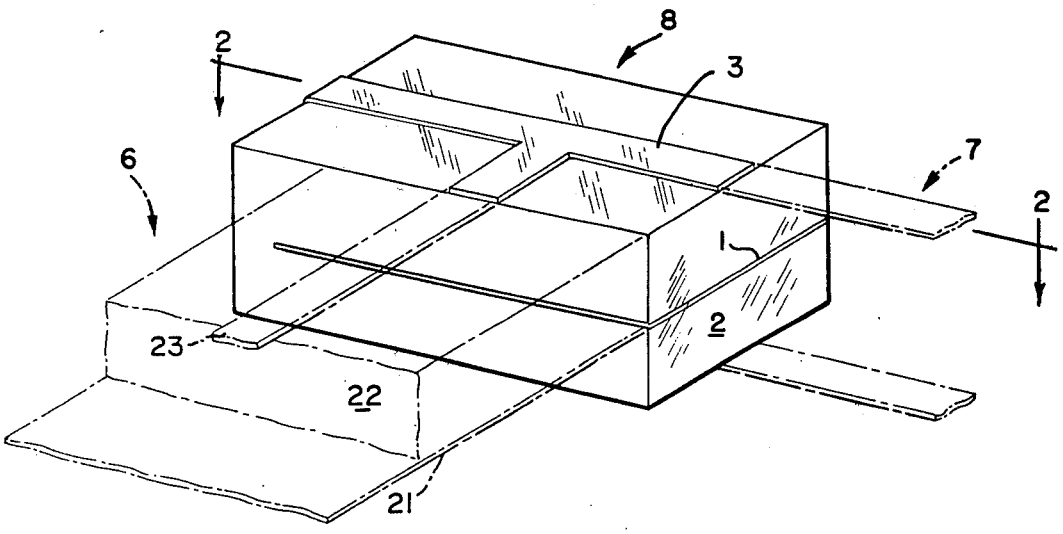
FIG. 1 is a perspective view of the balun block showing unbalanced and balanced input and output attachments, respectively.

Referring to the drawings forming a part hereof, the numeral 1 of FIG. 1 refers to a ground plane or metalized sheet as a first conductor and forming a base reference for the electromagnetic field in the device. This ground plane is supported by a dielectric material indicated by the numeral 2.

A second conductor above and below the ground plane is indicated by the numeral 3.

The interconnection of balanced and unbalanced components is also shown in FIG. 1. The unbalanced component (microstrip) input transmission line shown in phantom and not a part of the present invention is indicated at 6 and comprises a ground plane 21, a dielectric substrate 22, and a separate strip conductor 23. The balun block itself is indicated by numeral 8. The block is essentially the dielectric 2 with the ground plane 1 in the center and the conduction strips 3 on outer surfaces. Emerging from the balun block on the right hand side are the two conductors of the balanced line indicated by numeral 7. These are extensions from the conductors indicated by numeral 3.

Figure 2A:
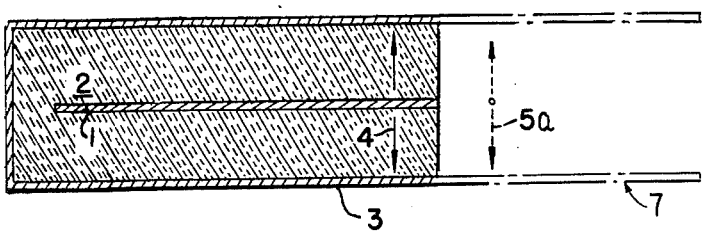
FIGS. 2A and 2B are side view sections along plane 2—2 of the balun in FIG. 1 showing wave recombination.
Figure 2B:
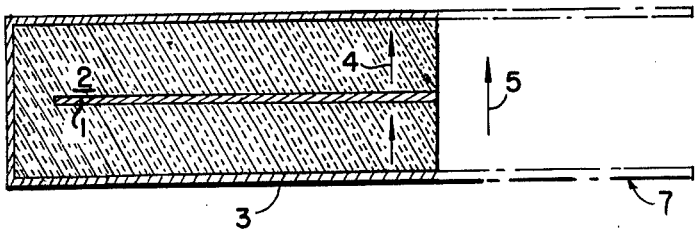

In FIGS. 2A and 2B, the phase relationship of the electric component of the electromagnetic field is displayed as shown by the field arrows 4 and 5. Those with skill in the art will note from FIG. 2A that the electric fields of the upper and lower microstrip output transmission lines 7, at the point of recombination, are in phase relative to the ground plane as indicated by the electric field arrows 4. Thus, when the ground plane terminates and the output wave is launched between the transmission lines, the fields cancel (perfect reflection). The net field is zero as shown by the vector summation indicated by numeral 5a. In FIG. 2B, it will be seen that the electric fields are 180"electrical" degrees out of phase (relative to the ground plane) at the point of recombination so that when the ground plane terminates, the field components reinforce as shown by the vector summation of the combined field as indicated by numeral 5 in FIG. 2B and a balanced output wave is transmitted.

Figure 3A:
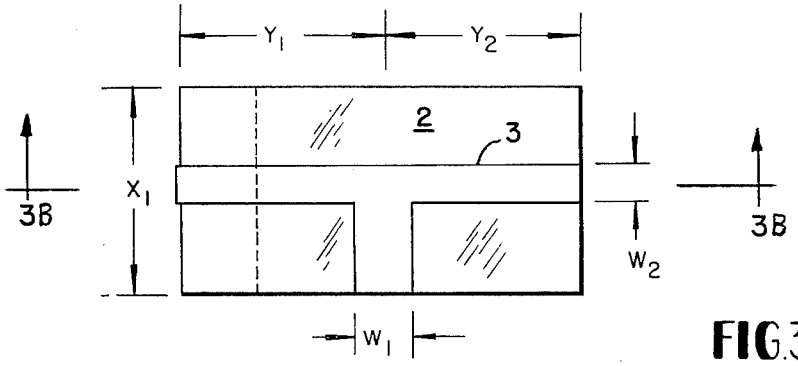
FIG. 3A shows a top view and FIG. 3B shows a side view section of the balun block of FIG. 3A with indications of the important dimensions.
Figure 3B:
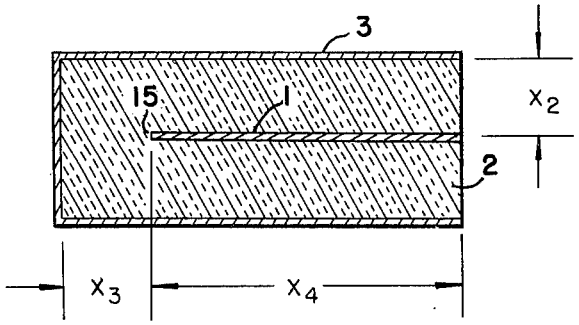

The balun block as a separate entity is shown in FIGS. 3A and 3B with important dimensions indicated. $W_1$ is the unbalanced microstrip conductor width and $W_2$ is the width of the upper and lower conductors at the point they are launched into the balanced line. Ground plane 1, dielectric block 2, and the microstrip conductor 3 are exactly as explained for FIGS. 1 and 2. (Note that the ground plane within the dielectric block does not span the entire block, and also that the leftmost conductor in the top view, FIG. 3A, must fold around the block to emerge from the lower, unseen portion of the block in this Figure but is seen in FIG. 3B.

Block dielectric material should be good quality, low-loss microwave dielectric of any relative permittivity. In order to match the balun to the incoming microstrip, it is appropriate to use the medium of the microstrip and thereby eliminate an unnecessary matching section.

Block width $X_1$, is not critical, but it should be wide enough to maintain the dominant quasi-TEM mode in a microstrip. This width must then be at least 10 times the microstrip depth as indicated in FIG. 3B by the dimension $X_2$.

Block depth $2X_2$ may be designed to match the external microstrip line. An alternative approach is to match the block depth to the external balanced line conductor separation, but it is much easier to match the latter separation by quarter wave sections than it is to match the former by quarter wave sections.

Block length $X_3 + X_4$ will depend upon the strip lengths and will be discussed later. The length $X_3$ should theoretically be equal to the microstrip depth, however, due to fringing effects at the edge of the ground plane, $X_3$ will be approximately $0.88\ X_2$.

Strip width $W_1$ is determined by impedance match requirements to the input unbalanced line. This requires a knowledge of the dielectric depth $X_2$, the relative permittivity of the dielectric substrate and the center frequency.

Strip width $W_2$ is selected so that the parallel combination impedance of the two power splitting arms will equal the impedance of the input line.

Strip length $Y_2$ is not a critical length, but it must be long enough to allow complete separation of the input into its two component parts. Too short a $Y_2$ will result in fringing reflections at the T junction. A good value for $Y_2$ is one quarter wavelength. This should be long enough to minimize fringing while optimizing the eventual balanced line match.

Strip length $Y_1$ must be carefully selected so that the total length $(2Y_1 + 2X_2)$ around the end path is exactly one-half wavelength ($\lambda$) or an odd multiple thereof. Then, for a three half-wavelength design:

$$2Y_1 + 2X_2 = n\ \lambda/2 = 3\ \lambda/2$$

$$Y_1 = 0.75\ \lambda - X_2$$

Lastly, the block length can be computed, for once $Y_1$ is known, the length $X_4$ can be determined.

$$X_4 = Y_1 + Y_2 - X_3$$

$$X_4 = 0.75\ \lambda - X_2 + \lambda/4 - 0.88\ X_2$$

$$X_4 = \lambda - 1.88\ X_2$$

$$X_3 + X_4 = 0.88\ X_2 + \lambda - 1.88\ X_2$$

$$X_3 + X_4 = \lambda - X_2$$

Figure 4A:
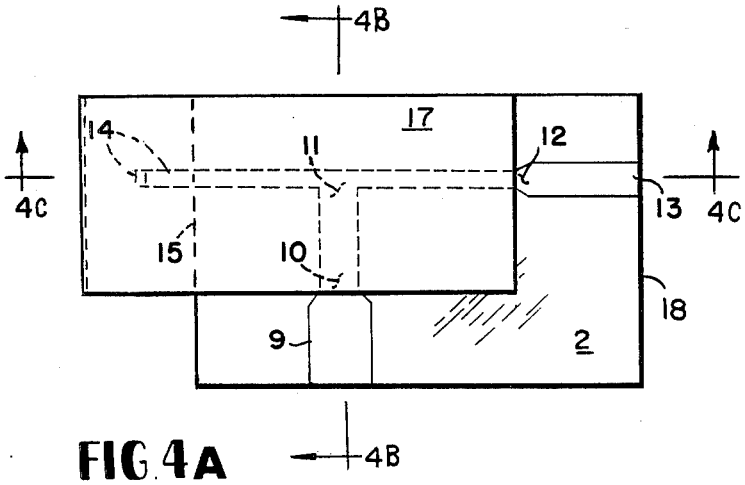
FIG. 4A shows a top view of a folded strip balun in a symmetric stripline configuration.

FIG. 4A shows a top view of a stripline version of the balun block. This version functions identically to the microstrip described above except that at each transverse propagation plane there appears a 3-conductor sandwich stripline in lieu of a 2-conductor microstrip. The transition from an unbalanced line to the 3-conductor stripline is not an integral part of this invention, and a microstrip to stripline transition region is shown as an example only.

Figure 4B:
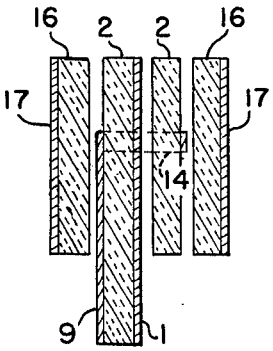
FIG. 4B taken along plane 4B—4B in FIG. 4A is a right side view section of this configuration, slightly exploded to illustrate presence of thin conduction surfaces.
Figure 4C:
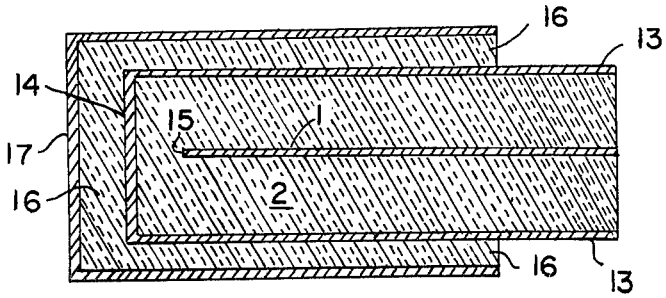
FIG. 4C is a sectional front view taken along the plane 4C—4C in FIG. 4A.

The external interface from the unbalanced input line is indicated by the numeral 9 and numeral 10 indicates the transition region from microstrip to stripline. The conductor strip becomes narrower at this point and an additional ground plane is added over the strip. A power splitter is fundamental to the design and this is indicated in this stripline version by numeral 11 at the stripline T junction. The stripline path to the left must bend around the central ground plane 1 of the block. Thus, as seen in FIG. 4C, the center conductor 14 of the stripline bends downward on its path around the end 15 of ground plane 1 but spaced therefrom similar to the positioning of conductor 3 in FIGS. 3A and 3B. The outermost ground plane 17 of the stripline continues around the center conductor 14 to maintain a uniform transmission line, but at a fixed distance from the conductor 14 with an additional dielectric member 16 between them.

In manufacturing the stripline, dielectric member 2 is laid down around ground plane 1. The metallic conductors including conductor 14 are then laid on the dielectric 2. Dielectric member 16 is of the same component as dielectric member 2. Thus, when dielectric member 16 is laid down it coalesces or melds with dielectric number 2 so there is no joint showing between the two dielectric members. Ground plane 17 is then wrapped around dielectric member 16 as best seen in FIGS. 4A and 4C. The metallic conductors would have a thickness of about 0.0002 inches and cannot be felt to be above the surface of the dielectric members nor seen to protrude from them.

To provide for attachment of the stripline to a balanced output line, a transition region from stripline to microstrip is employed and as seen in FIG. 4A is indicated by numeral 12, this being the last step in transforming the unbalanced input wave before emerging at the right as the balanced output energy wave. This is achieved at the truncation of the microstrip ground plane 15 at the edge 18 of the dielectric member 2. The stripline conductor 14 for the balanced line terminates on the underside of the stripline in a transition region (not seen) which is identical to transition region 12 seen in FIG. 4A. An external interface from transition region 12 to the balanced output line is indicated by numeral 13 in FIG. 4A along with an identical counterpart on the underside of dielectric member 2 as seen in FIG. 4C. An exploded view of the stripline cross section is shown in FIG. 4B with the four dielectric regions separated for clarity.

Figure 5A:
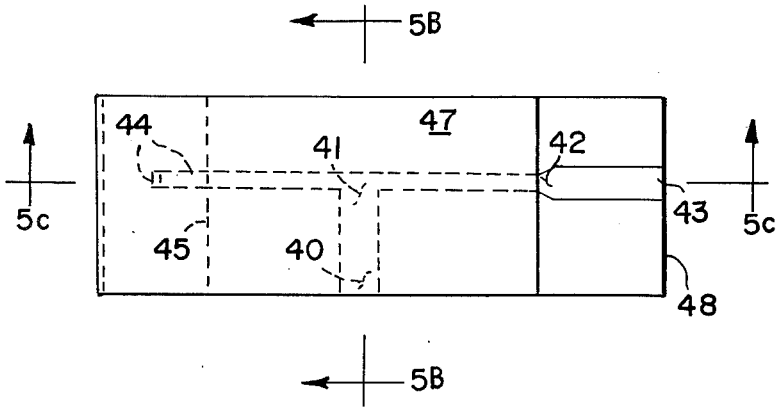
FIG. 5A shows a top view of a folded strip balun in a 3-conductor sandwich strip line configuration.
Figure 5B:
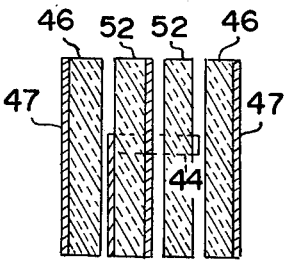
FIG. 5B taken along plane 5B—5B in FIG. 5A is a right side view section of this configuration, slightly exploded to illustrate presence of thin conduction surfaces.
Figure 5C:
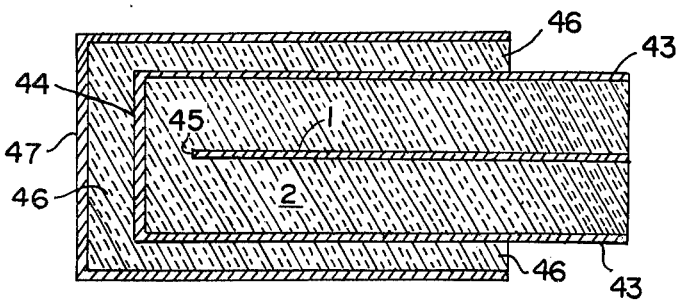
FIG. 5C is a sectional front view taken along the plane 5C—5C in FIG. 5A.

FIGS. 5A, 5B and 5C show views of another stripline version of the balun block. This version functions identically to the stripline described above except that at each transverse propagation plane there appears a 3-conductor sandwich stripline in lieu of a 2-conductor microstrip.

The power splitter is also fundamental to the design and this is indicated in this stripline version by numeral 41 at the stripline T junction. The stripline path to the left must bend around the central ground plane 1 of the block. Thus, as seen in FIG. 5C, the center conductor 44 of the stripline bends downward on its path around the end 45 of ground plane 1 but spaced therefrom similar to the positioning of conductor 14 in FIG. 4C. The outermost ground plane 47 of the stripline continues around the center conductor 44 to maintain a uniform transmission line, but at a fixed distance from the conductor 44 with an additional dielectric member 46 between them.

To provide for attachment of this stripline to a balanced output line, use is made of a transition region 42 and an external interface 43 substantially identical in function to that shown in FIGS. 4A and 4C.

The microstrip and stripline embodiments shown and discussed herein are illustrations only of the scope of the present invention and are in no way limiting as to the scope of the invention which is defined in the claims.

What is claimed is:

1. A balun block for microwave and higher frequencies comprising a planar dielectric member, a ground plane of conductive material centrally positioned within said member and conducting means passing around three sides of said member in spaced relationship to said plane, said conducting means comprising means to receive an incoming guided energy wave and to split said incoming wave into two components of equal phase and means to conduct and recombine said components in predetermined phase relationships into an outgoing guided energy wave.

2. Balun block according to claim 1 wherein said incoming wave is unbalanced, said components are recombined in amplitude reinforcement and said outgoing wave is balanced.

3. Balun block according to claim 1 wherein said incoming wave is balanced, said components are recombined in equal phase relationships and said outgoing wave is unbalanced.

4. Balun block according to claim 1 wherein said conducting and recombining means comprises two opposed transmission portions having a difference in length equal to one-half wave length or odd multiples thereof.

5. Balun block according to claim 1 wherein said receiving and splitting means is a T junction.

6. Balun block according to claim 5 wherein said receiving and splitting means comprises a microstrip T junction.

7. Balun block according to claim 5 wherein said receiving and splitting means comprises a stripline T junction.

8. A planar microwave balun transformer comprising in combination:

a. a planar dielectric member;

b. a planar deposited thin metallic film forming a ground plane within the member;

c. a planar metallic film strip deposited on three sides of said dielectric member and forming a transmission line conducting means in conjunction with the ground plane, said conducting means forming a power division network wherein an input energy wave may be split into two component parts and a reforming network wherein the two component parts of the wave are combined to form a properly phased single transmittable energy wave, said transmittable wave being a balanced wave when the phases of said input wave are unbalanced, said transmittable wave being an unbalanced wave when the phases of said input wave are in balance.

* * * * *